US006505487B1

(12) United States Patent
Garel et al.

(10) Patent No.: US 6,505,487 B1
(45) Date of Patent: Jan. 14, 2003

(54) LOCKING DEVICE FOR USE WITH A PROJECTION LOCK AND METHOD FOR SECURING AN OBJECT WITH A PROJECTION LOCK

(75) Inventors: Michael R. Garel, Austin, TX (US); David W. Grunow, Round Rock, TX (US); Cassius J. Mullen, Georgetown, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 09/667,120

(22) Filed: Sep. 21, 2000

(51) Int. Cl.[7] ..... E05B 73/00

(52) U.S. Cl. ..... 70/18; 70/17; 70/19; 70/37; 24/499; 24/500; 24/509; 24/510

(58) Field of Search ..... 70/17, 18, 19, 70/37; 24/500, 509, 510, 499

(56) References Cited

U.S. PATENT DOCUMENTS

| | | | | | |
|---|---|---|---|---|---|
| 140,659 | A | * | 7/1873 | Tunstill | 70/510 |
| 307,487 | A | * | 11/1884 | Moore | 70/37 |
| 456,936 | A | * | 8/1891 | Blakely | 70/17 |
| 474,719 | A | * | 5/1892 | Brande | 24/457 |
| 683,286 | A | * | 9/1901 | Houser | 70/37 |
| 1,021,343 | A | * | 3/1912 | Tingley | 70/19 |
| 1,028,246 | A | * | 6/1912 | Moberg | 70/37 |
| 1,136,735 | A | * | 4/1915 | Taylor | 70/37 |
| 1,167,377 | A | * | 1/1916 | Brown | 70/37 |
| 1,408,133 | A | * | 2/1922 | Ochs et al. | 70/18 |
| 1,447,374 | A | * | 3/1923 | Bowzer | 70/19 |
| 1,585,962 | A | * | 5/1926 | Bray | 70/202 |
| 2,531,033 | A | * | 11/1950 | Slaker | 24/510 |
| RE23,472 | E | * | 3/1952 | Kindlund et al. | 24/3.11 |
| 3,667,259 | A | | 6/1972 | Reque et al. | |
| 4,085,599 | A | | 4/1978 | Fischer et al. | |
| 4,932,955 | A | * | 6/1990 | Merz et al. | 606/158 |
| 5,117,661 | A | | 6/1992 | Carl et al. | |
| 5,197,309 | A | * | 3/1993 | Del Rosario | 70/209 |
| 5,381,685 | A | * | 1/1995 | Carl et al. | 70/78 |
| 5,381,989 | A | * | 1/1995 | Jackson | 248/122 |
| 5,673,574 | A | | 10/1997 | Bertram | |
| 5,791,171 | A | | 8/1998 | Kelley | |
| 5,995,366 | A | | 11/1999 | Howell et al. | |
| 6,006,557 | A | | 12/1999 | Carl et al. | |
| 6,185,795 | B1 | * | 2/2001 | Shui-Shang | 24/507 |

* cited by examiner

*Primary Examiner*—Robert J. Sandy
*Assistant Examiner*—Carlos Lugo
(74) *Attorney, Agent, or Firm*—J. Nevin Shaffer, Jr.; Shaffer & Culbertson, LLP

(57) ABSTRACT

A locking device (1) includes a first clip member (20) and a second clip member (40). The first and second clip members (20, 40) include a first and second clip base (21, 41), respectively. A first jaw (22) extends outwardly from the first clip base (21) whereas a second jaw (42) extends outwardly from the second clip base (41). The first and second clip members (20, 40) are connected together so that they may move with respect to each other between a closed position and an open position. In the closed position, the first and second jaws (22, 42) cooperate to form a locking loop (6). The locking loop (6) is adapted to fit through and lock with a locking feature (32) on an object to be secured. When the first and second clip members (20, 40) are moved to the open position, the first and second jaws (22, 42) are separated by an opening. This opening facilitates positioning the locking device (1) with the locking feature (32) to permit the first and second jaws (22, 42) to pass through the feature (32) when moved to the closed position. The locking device (1) further includes a receiver arrangement (10) located on the first and second clip bases (21, 41). The receiver arrangement (10) forms a projection lock receiver opening for receiving a projection lock when the clip members are in the closed position.

17 Claims, 5 Drawing Sheets

LOCKING DEVICE FOR USE WITH A PROJECTION LOCK AND METHOD FOR SECURING AN OBJECT WITH A PROJECTION LOCK

CROSS-REFERENCE TO RELATED APPLICATION

This application is related to pending U.S. patent application Ser. No. 09/518,291, filed Mar. 3, 2000, entitled PROJECTION LOCK RECEIVER AND METHOD FOR USING A PROJECTION LOCK. The Applicants claim the benefit of this related application under 35 U.S.C. §120, and the entire disclosure of this related application is incorporated herein by this reference.

TECHNICAL FIELD OF THE INVENTION

This invention relates to locking systems of particular use in locking portable computers and similar devices. More specifically, the invention relates to a locking device for use in combination with a Kensington style or other projection lock to secure an object such as a computer system which is not specifically designed for use with a projection lock.

BACKGROUND OF THE INVENTION

Portable computer systems have become very popular to both business travelers and users who simply prefer the flexibility provided by portable systems. Aside from the portable computer systems themselves, many types of accessories have been developed to increase the functionality and utility of portable computer systems. For example, many modular devices such as modular CD drives have been developed specifically for use with portable computer systems. These modular devices simply plug into modular receptacles built in the portable computer and may be readily removed and switched out for other devices. Also, docking stations have been developed for receiving a portable computer so that the portable computer may be used conveniently at a fixed location. These docking station/portable computer combinations provide many of the benefits of standard computer systems while allowing the portable computer to be removed for use out of the office.

Although such portable systems present many advantages, the portability and modular nature of these systems does raise security issues. In particular, portable computers and the modular components used in portable and other computer systems have been easy targets for thieves. To address security issues, many locking arrangements have been developed for securing a computer system and its various components in place. Computer system and accessory manufacturers, are also incorporating security features into their products and providing attachments and structures intended to accommodate a variety of locks. Docking stations have been developed with comprehensive locking arrangements which can be actuated to lock in place both the portable computer received in the station and other modular components. Once actuated, the locking arrangement can be fixed in place using a padlock or other type of lock. This allows a single lock to effectively secure an entire modular system.

A popular lock for use in securing electronic devices, commonly referred to as a Kensington lock, has been developed by Kensington Microware, Ltd. of San Mateo, Calif. Various embodiments of a Kensington lock are disclosed in U.S. Pat. No. 5,381,685, and the disclosure for this patent is incorporated herein by reference. A Kensington lock includes a locking projection which cooperates with a special receptacle feature on the device to be secured. The locking projection is mounted on a base which itself may be connected to a cable or chain that is secured at its opposite end. The receptacle feature on the device to be secured comprises a rectangular slot having preselected dimensions. The Kensington lock is used by first positioning the locking projection in the receptacle and then turning an end portion of the locking projection using a key for the lock. The turned end portion now misaligns with the slot and prevents the projection from being removed from the slot until turned back to the aligned position using the key for the lock. Many portable computer users prefer Kensington locks for their compact nature, portability, and ease of use.

A lock which uses one or more projections to cooperate with a specially sized opening will be referred to in this disclosure as a "projection lock." The term "projection lock" is intended to encompass Kensington locks and similar locking devices. The opening with which a projection lock is intended to cooperate may be referred to generally as a "projection lock receiver opening."

Portable computer and docking station manufacturers commonly provide structures or attachments on their products which accommodate different types of locks so as to give the customer a choice of security solutions. For example, a portable computer may include both a projection lock receiver opening and an opening for receiving a padlock. A problem arising in some instances, however, is that the projection lock receiver opening location may be so close to a system component that the installed projection lock blocks access to the component. As a result, the user is forced to remove the projection lock in order to gain full access to the blocked component. In order to avoid having to continually lock and unlock the system to gain the desired access, the user may abandon their projection lock and use an alternative device, such as a padlock to lock the computer system.

Another problem arises when a computer system does not include the special receiver opening required by a projection lock. In this case, the only alternative is to use a padlock rather than a projection lock.

Whether the projection lock is abandoned because the projection lock receiver opening is inconveniently located or because the receiver opening is not available at all, the user is forced to abandon what may be their preferred security device. This is particularly unsatisfactory in corporations that have standardized on a particular projection lock.

SUMMARY OF THE INVENTION

It is an object of the invention to provide a locking device for use in combination with a projection lock to secure an object that may not be specifically designed for use with a projection lock. Another object of the invention is to provide a method for securing a device with a projection lock.

A locking device according to the invention includes a first clip member and a second clip member, each including a clip base and jaw portion. The first clip member includes a first clip base, while the second clip member includes a second clip base. A first jaw extends outwardly from the first clip base whereas a second jaw extends outwardly from the second clip base.

The first and second clip members are connected together so that they may move with respect to each other between a closed position and an open position. Preferably, a coupling element such as a rivet connects the first and second clip members so that the clip members may pivot with respect to each other between the open and closed position. In the closed position, the first and second jaws cooperate to form a locking loop. The locking loop is adapted to fit through or in a feature such as a padlock receiving opening or other similar feature on an object to be secured. A feature on a device to be secured which cooperates with the locking loop according to the present invention will be referred to in this disclosure and the accompanying claims as a "locking feature."

When the first and second clip members are moved to the open position, the first and second jaws are separated by an opening. This separation between jaws allows the jaws to be aligned with the locking feature on the device to be secured so that the jaws move into or through the locking feature when the clip members are moved to the closed position. A biasing element positioned between the first and second clip members preferably biases the first and second clip members to the closed position with the jaws closed together to form the locking loop.

The locking device includes a receiver arrangement located on the first and second clip bases. When the clip members are in the closed position, the receiver arrangement forms a projection lock receiver opening for receiving the projection portion of a projection lock, such as a Kensington lock for example. The projection portion received in the receiver arrangement secures the clip members in the closed position with the jaws forming the locking loop. Thus, the locking loop may be placed in or through a locking feature on an object and then a projection lock may be used on the locking device to secure the locking device on the object.

The preferred receiver arrangement includes a projection slot extending through the first clip base. The receiver arrangement also includes an interference receptacle formed on the second clip base. This interference receptacle is adapted to align with the projection slot when the first and second clip members are in the closed position. The aligned interference receptacle and the projection slot define the projection lock receiver opening for receiving a projection lock therein.

Moving the clip members to the open position causes the interference receptacle and the projection slot to move laterally out of alignment. However, when a projection portion of a projection lock is placed in the receiver arrangement, the projection portion extends through the projection slot and into the interference receptacle. This positioning prevents the interference receptacle from moving out of alignment with the projection slot, and thus prevents the first and second clip members from moving to the open position once the projection portion of the projection lock in place.

The locking device according to the invention allows a projection lock to be conveniently used to secure a device even if the device includes no built-in projection lock receiver opening, or if the projection lock receiver opening on the device is inconveniently located. A company may thus standardize on the projection lock solution without having to worry about incompatibility between projection locks and devices to be secured. Furthermore, the receiving arrangement according to the invention is portable from one security application to the next.

These and other objects, advantages, and features of the invention will be apparent from the following description of the preferred embodiments, considered along with the accompanying drawings.

DESCRIPTION OF THE PREFERRED EMBODIMENTS

Figure 1:
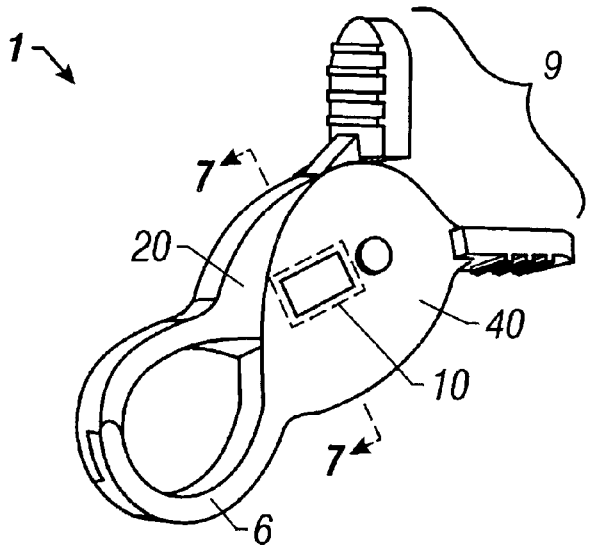
FIG. 1 is an isometric view of a locking device embodying the principles of the invention while in a closed position.
Figure 2:
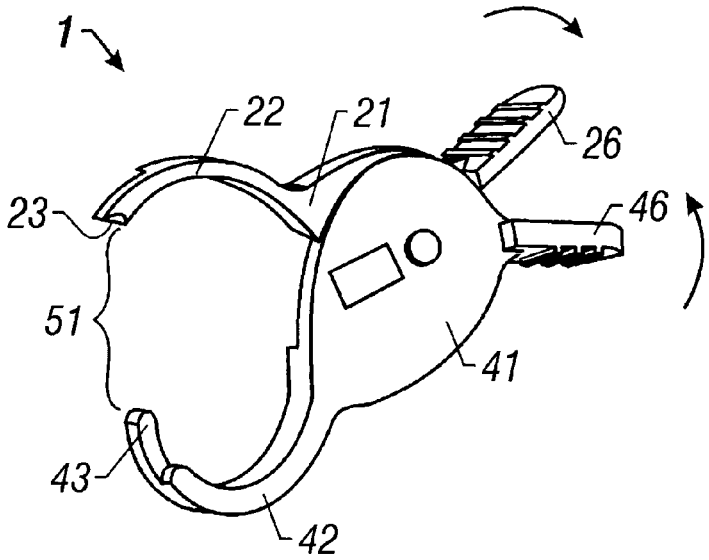
FIG. 2 is an isometric view of the locking device of FIG. 1 in an open position.

A preferred embodiment of the present invention is illustrated by way of example in FIGS. 1 through 4. With specific reference to FIGS. 1, 2, and 4, the locking device 1 includes a first clip member 20, a second clip member 40, and a receiver arrangement shown generally at reference numeral 10. Shown best in FIG. 4, the first clip member 20 includes a first clip base 21. A first jaw 22 extends outwardly from the clip base 21 to a first distal end 23. The first jaw 22 preferably has a curved shape. The second clip member 40 is similar to the first clip member 20, and includes a second clip base 41 with a second jaw 42 extending outwardly therefrom to a second distal end 43. The second jaw 42 is also preferably curved to oppose or "mirror" the curved shape of the first jaw 22. The distal end of the first jaw 22 and the distal end of the second jaw 42 may thus meet to form a locking loop 6 shown in FIG. 1.

Figure 3:
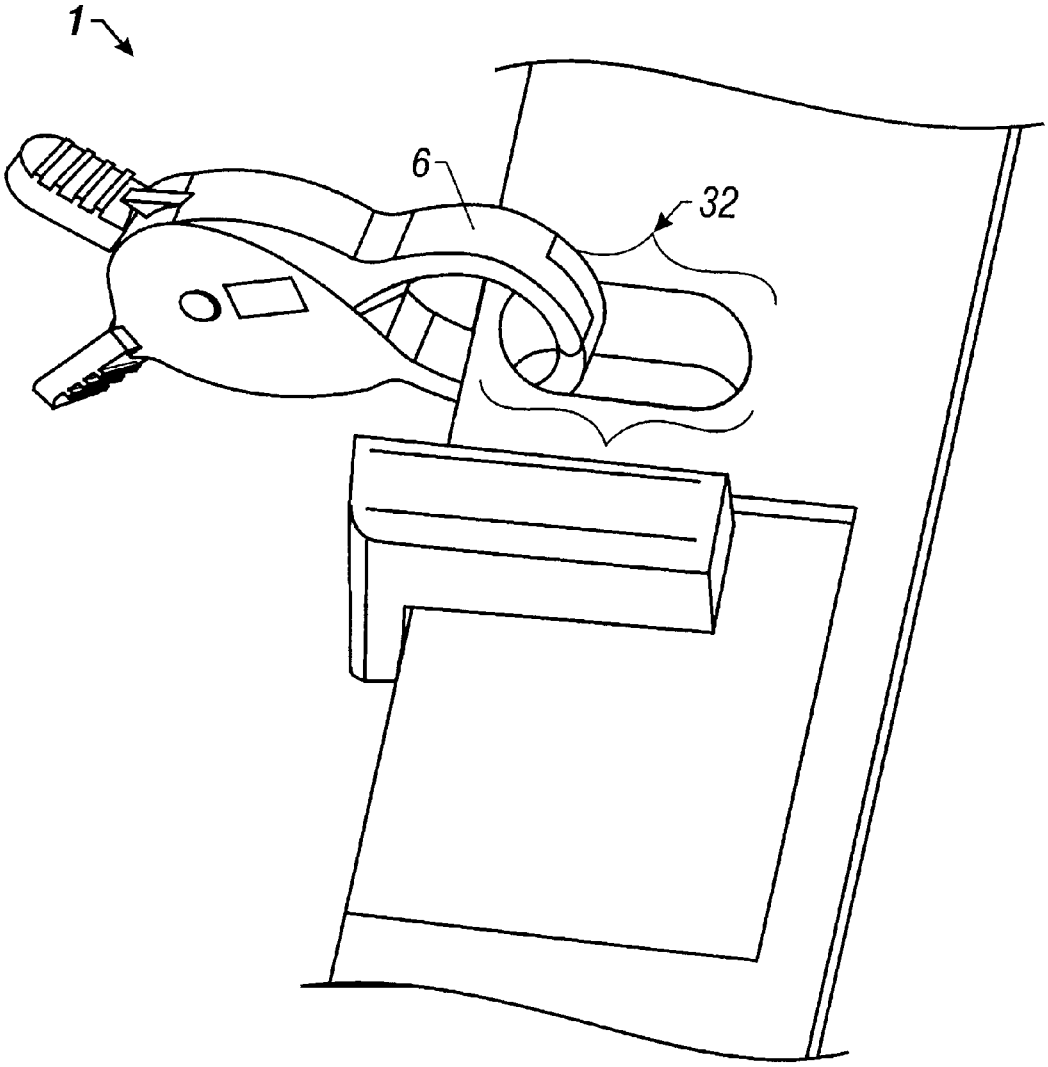
FIG. 3 is an isometric view of the locking device of FIG. 1 attached to a modular computer system through a locking feature located on the modular computer system.

In FIG. 3, the locking loop 6 secures the locking device 1 to a docking station locking feature 32 discussed in detail below. Those of ordinary skill will recognize that the locking loop 6 may cooperate with any suitable feature on an object to secure the locking device 1.

As a result of symmetrically opposing and curved first and second jaws, 22 and 42, respectively, the locking loop 6 preferably comprises an "O"-shape. Those of ordinary skill in the art will recognize other suitable shapes for each jaw and resulting locking loop. For example, a locking loop according to the invention may be square or triangular.

The locking loop 6 has a substantially uniform loop thickness. That is, the thickness of the material is generally the same at different points about the locking loop 6. A uniform loop thickness permits the locking loop 6 to slide easily through the docking station locking feature 32, especially if the locking feature has close tolerance with the locking loop.

Figure 4:
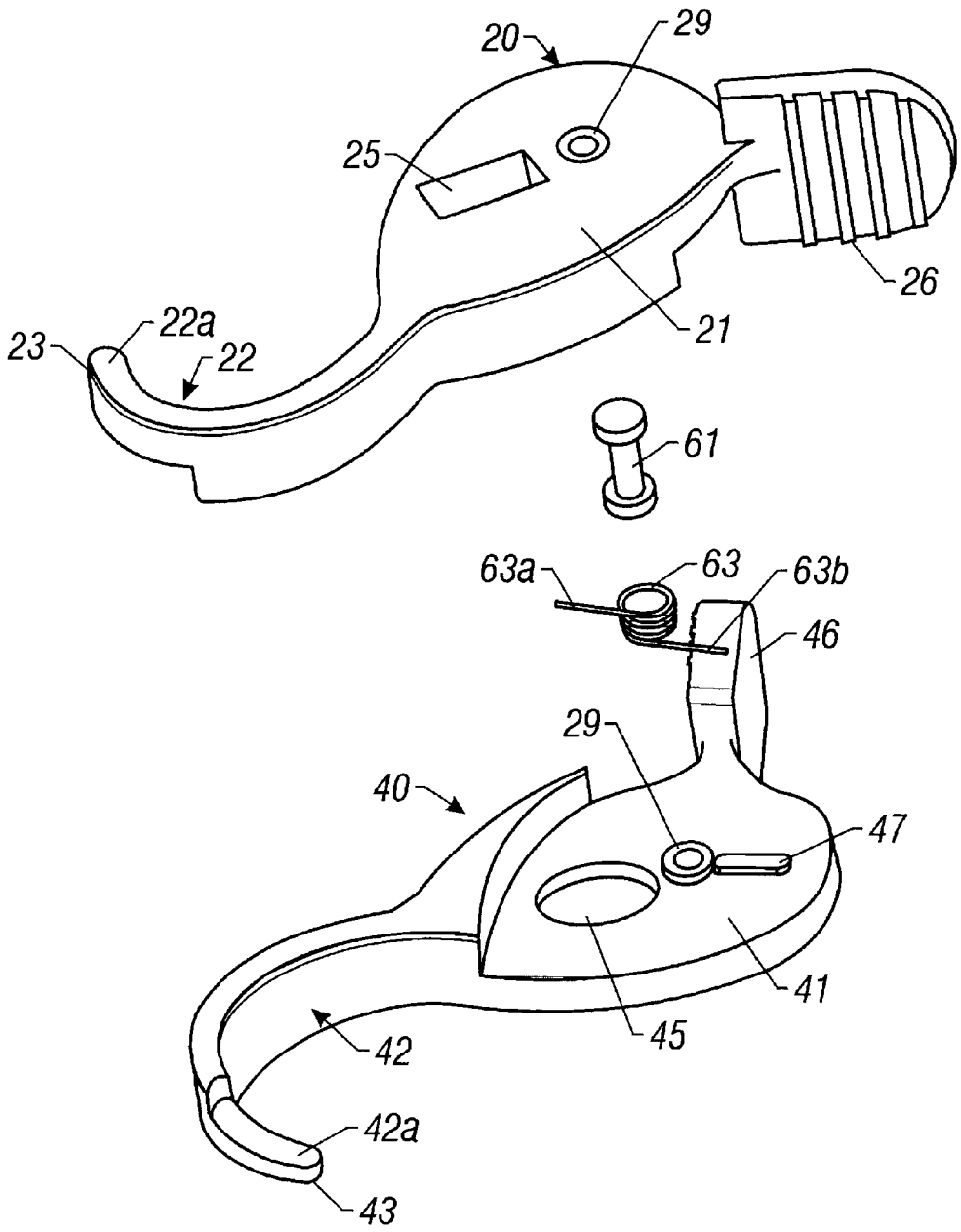
FIG. 4 is an exploded view of the locking device of FIG. 1.

In the preferred form of the invention shown in the figures, interlocking sections are provided along each jaw to allow the jaws to overlap in the closed position and still produce a locking loop 6 having a uniform thickness. In particular, as shown in FIG. 4, the first jaw 22 includes interlocking section 22*a*. Similarly, the second jaw 42 includes interlocking section 42*a*. The overlapped portion of the locking jaws makes it more difficult to separate the jaws when they are closed together through a locking feature such as that shown at 32 in FIG. 3.

It will be appreciated that the locking device 1 can be made of any materials having sufficient strength and resistance to breakage. Hardened steel and similar materials are ideal for the clip members 20 and 40 according to the invention.

The locking feature 32 shown in FIG. 3 comprises a standard padlock shackle receiving opening. In order to place locking device 1 in the position shown in FIG. 3, the first and second clip members 20 and 40 are first pivoted from the closed position shown in FIG. 1 to the open position shown in FIG. 2. In this open position the first and second jaws 22 and 42 are separated by an opening shown in FIG. 2 at reference numeral 51. Opening 51 allows the jaws 22 and 42 to be aligned so that the distal ends 23 and 43 of the jaws may close together through the locking feature 32. This forms the closed loop 6 through the locking feature 32 shown in FIG. 3.

Referring now particularly to FIG. 4 the locking device 1 further includes a coupling element 61 for connecting the first and second clip members 20 and 40. In the preferred embodiment, the coupling element 61 is a rivet extending through the locking device 1 along a coupling bore 29. The rivet connects the first and second clip members 20 and 40, so that the clip members may pivot with respect to each other between the closed and open positions shown in FIGS. 1 and 2.

Locking device 1 also includes a lock actuator 9 for moving the clip members 20 and 40 from the closed to open position. As shown best in FIGS. 1 and 2, the lock actuator 9 includes a first lever 26 and a second lever 46. The first lever 26 extends outwardly from the first clip base 21 whereas the second lever 46 extends outwardly from the second clip base 41. An operator may place their fingers on both the first and second levers 26 and 46 and squeeze the levers together to pivot the clip members 20 and 40 from the closed position shown in FIG. 1 to the open position in FIG. 2.

Figure 5:
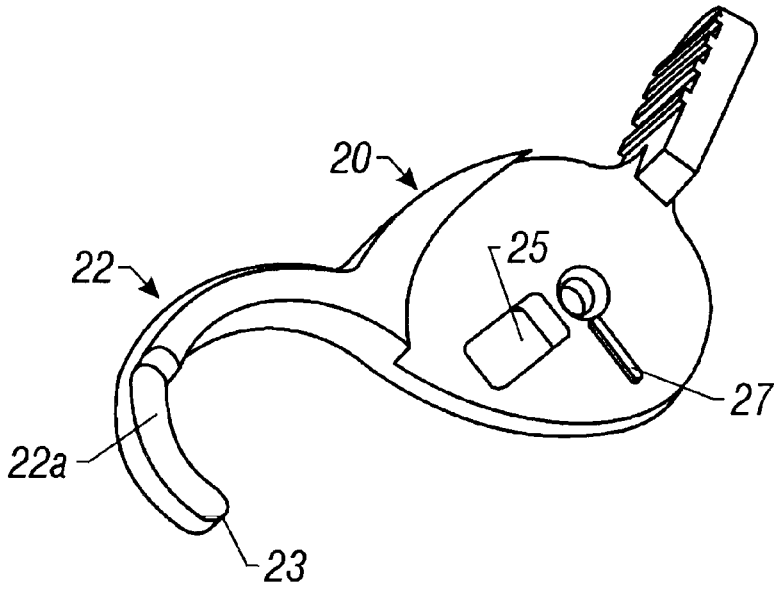
FIG. 5 is an isometric view showing the opposite side of clip member 20 from FIG. 4.

Referring still to FIG. 4, a biasing element 63 is provided for biasing the first and second clip members 20 and 40 to the closed position in which jaws 22 and 42 form the locking loop 6. In the preferred embodiment, the biasing element 63 is a spring acting between the first and second clip base 21 and 41. The spring is mounted on coupling element 61 and includes extensions 63*a* and 63*b*. Spring extension 63*b* is adapted to abut ledge 47 and the second clip base 41 as shown in FIG. 4, while spring extension 63*a* is adapted to abut ledge 27 on the first clip base 21 shown in FIG. 5.

The receiver arrangement 10 in the illustrated form of the invention is located on the first and second clip bases 21 and 41, respectively. Receiver arrangement 10 provides a projection lock receiver opening by which the locking device may be locked in the closed position using a projection lock. The preferred receiver arrangement 10 includes a projection slot 25. Referring to FIG. 4, the projection slot 25 extends through the clip base 21 of first clip member 20. The receiver arrangement 10 also includes an interference receptacle 45 formed on the second clip base 41. The preferred interference receptacle comprises a cylindrical opening. This opening forming the interference receptacle 45 need not extend all the way through the second clip base 41, although it may extend entirely through the second clip base within the scope of the invention. In any event, the interference receptacle 45 is adapted to align with the projection slot 25 when the first and second clip members 20 and 40 are in the closed position. The interference receptacle 45 and the projection slot 25 move laterally out of alignment when the first and second clip members 20 and 40 are moved from the closed to the open position.

Figure 6:
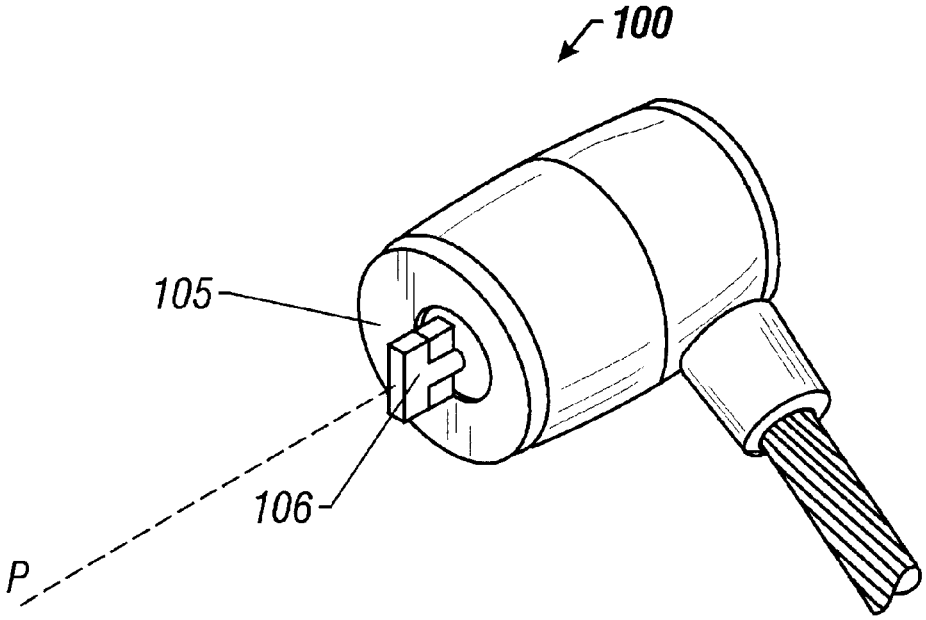
FIG. 6 (Prior Art)
FIG. 6 is an isometric view of a prior art projection lock for use with a locking device.
Figure 7:
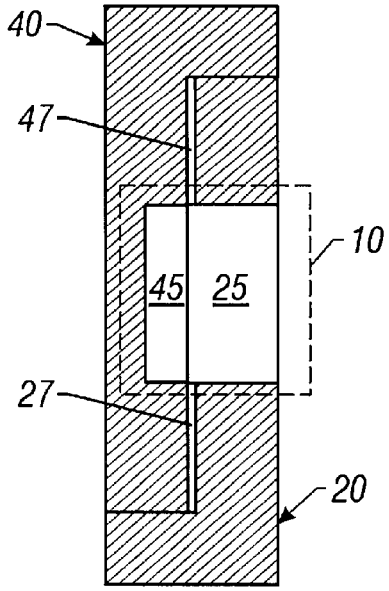
FIG. 7 is a section taken along the line 7—7 in FIG. 1 illustrating a receiving arrangement for receiving a projection lock therein.
Figure 8:
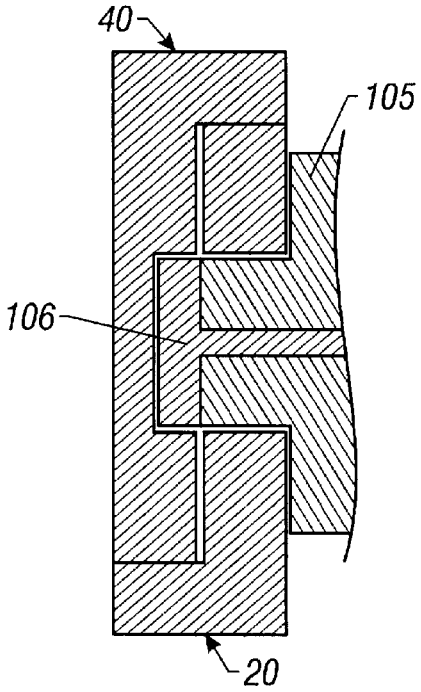
FIG. 8 is a section view similar to FIG. 7, but with a projection structure from the projection lock inserted within the receiving arrangement.
Figure 9:
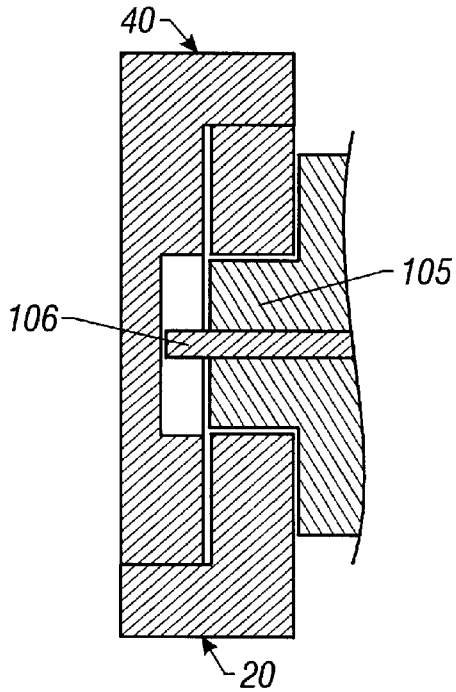
FIG. 9 is a section view similar to FIG. 8, but with the projection structure misaligned to secure the locking device in the closed position

The cooperation between the locking device 10 and a projection lock such as that shown in FIG. 6 may be described with particular reference to the section views of FIGS. 7 through 9. Referring first to FIG. 6, a prior art projection lock 100 suitable for use with a locking device according to the present invention includes a projection structure having a projection base 105 and a projection end 106. The projection end 106 is adapted to be pivoted with respect to the projection base 105 about pivot axis P in FIG. 6. In particular, the projection end 106 is adapted to move from an aligned, insertion position shown in the figure to a locked position in which it is misaligned with respect to base 105. Although it is not necessary for the projection end 106 to pivot 90° with respect to the base 105, it should be assumed for the purposes of this description that end 106 is adapted to misalign with base 105 by pivoting a full 90° about axis P.

Referring now to FIG. 7, a section through locking device 1 shows receiver arrangement 10 with the clip members 20 and 40 in the closed position. In this position, the projection slot 25 is aligned with the interference receptacle 45 so that the aligned projection structure of lock 100 may be inserted into the area defined by the projection slot 25 and interference receptacle 45 to the position shown in FIG. 8. In the position shown in FIG. 8, the projection end 106 of the projection lock 100 resides in the interference receptacle 45, while the projection base 105 resides in the projection slot 25. The position of the lock 100 with respect to the slot 25 and receptacle 45 shown in FIG. 8 may be referred to as an operating position.

FIG. 9 shows the same structure shown in FIG. 8, but with the projection end 106 of the projection lock 100 misaligned with the projection base 105 by being pivoted 90° with respect to the projection base. It will be noted referring back to FIG. 4 that the interference receptacle 45 is circularly or cylindrically shaped to accommodate the pivoting movement of the projection end 106. This pivoted position of end 106 misaligns the projection end 106 with receiver slot 25 so that the projection lock 100 may not be withdrawn from the illustrated position. That is, the projection base 105 is received in slot 25 with relatively close tolerance so that the lock 100 itself cannot be rotated with respect to the locking device 1. Since the lock 100 cannot be rotated to realign the projection end 106 with the receiver slot 25, the projection lock 100 cannot be withdrawn from the receiver arrangement 10.

Also, with the projection lock 100 in the position shown in FIG. 9, the first clip member 20 may not be pivoted with respect to the second clip member 40. In particular the presence of the projection end 106 in the interference receptacle 45 and the close tolerance between end 106 and the receptacle 45 does not allow the clip members 20 and 40 to be pivoted with respect to each other. Contact between the receptacle and the projection end 106 interferes with and prevents any such movement between clip members 20 and 40.

Although the figures illustrate one preferred locking device according to the invention, those skilled in the art will appreciate that there are many variations of the device within the scope of the invention as defined in the following claims. For example, although the interference receptacle 45 is shown in the figures as a pocket formed on the base of the second clip member 40, the receptacle may extend all the way through the second clip member. Furthermore, depending upon the thickness of locking device 1 and the size of the projection base of the projection lock, it is possible that the projection base could extend through both the slot 25 and interference receptacle 45. In this embodiment the receptacle 45 would comprise a slot similar to slot 25 and the projection end of the lock would misalign with both receptacle 45 and slot 25 to prevent the lock from being removed. It is also possible within the scope of the invention that a portion of the interference receptacle 45 could be located on the inside surface of the clip member 20.

A further alternative within the scope of the present invention is related to the locking loop 6. Although illustrated in the figures as a closed loop, it is also possible that the ends of the opposing jaws do not meet when the clip members 20 and 40 are in the closed position. This form of the invention would be adapted to cooperate with a locking feature that need not form a complete opening through a device to be secured.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A locking device for use with a projection lock having a projection structure adapted to be received in a projection lock receiver opening, the locking device comprising:

(a) a first clip member including a first jaw;

(b) a second clip member including a second jaw, the first and second clip members being connected together so that they may move with respect to each other between a closed position in which the first and second jaws cooperate to form a locking loop and an open position in which the first and second jaws are separated by an opening;

(c) a receiver arrangement located on a body portion of the first clip member and second clip member and combining to form a projection lock receiver opening, the receiver arrangement residing in an aligned condition when the first and second clip members are in the closed position and residing in a misaligned condition when the first and second clip members are in the open position; and (d) a biasing element acting between the first clip member and the second clip member for biasing the first clip member and the second clip member to the closed position.

2. The locking device according to claim 1 wherein:

(a) the first clip member includes a first clip base, the first jaw extending outwardly from the first clip base; and (b) the second clip member includes a second clip base, the second jaw extending outwardly from the second clip base.

3. The locking device according to claim 2 wherein the receiver arrangement is located on the first clip base and the second clip base.

4. A locking device for use with a projection lock having a projection structure adapted to be received in a projection lock receiver opening, the locking device comprising:

(a) a first clip member including a first jaw;

(b) a second clip member including a second jaw, the first and second clip members being connected together so that they may move with respect to each other between a closed position in which the first and second jaws cooperate to form a locking loop and an open position in which the first and second jaws are separated by an opening;

(c) a receiver arrangement located on the first clip member and second clip member and combining to form a projection lock receiver opening, the receiver arrangement residing in an aligned condition when the first and second clip members are in the closed position and residing in a misaligned condition when the first and second clip members are in the open position;

(d) wherein the first clip member includes a first base, the first jaw extending outwardly from the first clip base;

(e) wherein the second clip member includes a second clip base, the second jaw extending outwardly from the second clip base;

(f) wherein the first clip member includes a first lever, the first lever extending outwardly from the first clip base; and (g) the second clip member includes a second lever, the second lever extending outwardly from the second clip base.

5. The locking device according to claim 1 wherein the locking loop forms a closed loop.

6. The locking device according to claim 5 wherein the locking loop comprises a O-shaped loop.

7. The locking device according to claim 1 wherein the first jaw includes a portion which overlaps with a portion of the second jaw when the first and second clip members are in the closed position.

8. The locking device according to claim 1 wherein the receiver arrangement includes:

(a) an interference receptacle formed on the first clip member; and (b) a receiver slot formed on the second clip member.

9. The locking device according to claim 8 wherein the interference receptacle comprises a cylindrical opening in the first clip member.

10. A locking device for use with a projection lock having a projection structure adapted to be received in a projection lock receiver opening, the locking device comprising:

(a) a first clip member including a first jaw;

(b) a second clip member including a second jaw, the first and second clip members being connected together so that they may move with respect to each other between a closed position in which the first and second jaws cooperate to form a locking loop and an open position in which the first and second jaws are separated by an opening;

(c) a receiver arrangement located on the first clip member and second clip member and combining to form a projection lock receiver opening, the receiver arrangement residing in an aligned condition when the first and second clip members are in the closed position and residing in a misaligned condition when the first and second clip members are in the open position; and (d) a biasing element acting between the first clip member and the second clip member for biasing the first clip member and the second clip member to the closed position wherein the biasing element comprises a spring.

11. A locking device for use with a projection lock having a projection structure comprising a projection end and a projection base, the projection end being adapted to move between an insertion position and a locked position with respect to the projection base, the locking device comprising:

(a) a first clip member including a body and a first jaw;

(b) a second clip member including a body and a second jaw, the first and second clip members being connected together so that they may move with respect to each other between a closed position in which the first and second jaws cooperate to form a locking loop and an open position in which the first and second jaws are separated by an opening;

(c) projection slot extending through the body of the first clip member;

(d) an interference receptacle formed in the second clip member, the interference receptacle being aligned with the projection slot when the clip members are in the closed position and moving laterally with respect to the projection slot when the clip members are moved from the closed position to the open position, and (e) wherein the aligned projection slot and interference receptacle are adapted to receive the projection structure of the projection lock with the base of the projection lock residing in the projection slot and the end of the projection lock residing in the interference receptacle, and wherein the interference receptacle is adapted to allow the end of the projection lock to move to the locked position with respect to the projection lock base when the projection structure is in the operating position;

(f) wherein the first clip member includes a first clip base, the first jaw extending outwardly from the first clip base;

(g) wherein the second clip member includes a second clip base, the second jaw extending outwardly from the second clip base;

(h) wherein the first clip member includes a first lever extending outwardly from the first clip base; and (i) wherein the second clip member includes a second lever extending outwardly from the second clip base, whereby the first lever and the second lever are in position to move the first clip member and the second clip member from the closed position to the open position as said levers are pressed together.

12. The locking device according to claim 11 wherein:

(a) the projection slot is located on one of the first clip base or the second clip base, and (b) the interference receptacle is located on the other one of the first clip base or the second clip base.

13. The locking device according to claim 11 wherein the interference receptacle comprises a cylindrical opening.

14. A locking device for use with a projection lock having a projection structure comprising a projection end and a projection base, the projection end being adapted to move between an insertion position and a locked position with respect to the projection base, the locking device comprising:

(a) a first clip member including a first jaw;

(b) a second clip member including a second jaw, the first and second clip members being connected together so that they may move with respect to each other between a closed position in which the first and second jaws cooperate to form a locking loop and an open position in which the first and second jaws are separated by an opening;

(c) a projection slot extending through the first clip member; and (d) an interference receptacle formed in the second clip member, the interference receptacle being aligned with the projection slot when the clip members are in the closed position and moving laterally with respect to the projection slot when the clip members are moved from the closed to the open position, and (e) wherein the aligned projection slot and interference receptacle are adapted to receive the projection structure of the projection lock with the base of the projection lock residing in the projection slot and the end of the projection lock residing in the interference receptacle, and wherein the interference receptacle is adapted to allow the end of the projection lock to move to the locked position with respect to the projection lock base when the projection structure is in the operating position;

(f) wherein the first clip member includes a first clip base, the first jaw extending outwardly from the first clip base;

(g) wherein the second clip member includes a second clip base, the second jaw extending outwardly from the second clip base;

(h) wherein the first clip member includes a first lever extending outwardly from the first clip base;

(i) wherein the second clip member includes a second lever extending outwardly from the second clip base, whereby the first lever and the second lever are in position to move the first clip member and the second clip member from the closed position to the open position as said levers are pressed together; and (j) a biasing element acting between the first clip member and the second clip member for biasing the first clip member and second clip member to the closed position.

15. A method of securing an object with a projection lock, the method comprising the steps of:

(a) sliding a first receiver opening located on a body portion of a first clip member laterally into alignment with a second receiver opening located on a body portion of a second clip member, the aligned first and second receiver openings forming a projection lock receiver;

(b) closing a first jaw on the first clip member together with a second jaw on the second clip member to form a locking loop through an opening on the object as the first receiver opening slides into alignment with the second receiver opening;

(c) inserting a projection structure of the projection lock into the projection lock receiver formed by the aligned first and second receiver openings, and operating the projection lock to misalign an end portion of the projection lock with a base portion of the projection lock; and (d) connecting a biasing element between the first clip member and the second clip member for biasing the first clip member and second clip member to a closed position.

16. The method of claim 15 wherein the first receiver opening comprises a slot adapted to receive the base portion of the projection lock and the second receiver opening comprises a cylindrical opening adapted to receive the end portion of the projection lock and the step of operating the projection lock comprises rotating the end portion of the projection lock within the cylindrical opening.

17. The method of claim 13 wherein the step of closing the first jaw with the second jaw completely closes the locking loop.

* * * * *